US008752939B2

(12) United States Patent
Casella et al.

(10) Patent No.: US 8,752,939 B2
(45) Date of Patent: Jun. 17, 2014

(54) PRINTHEAD AND METHOD OF MAKING THE PRINTHEAD

(75) Inventors: James M. Casella, Webster, NY (US); Santokh S. Badesha, Pittsford, NY (US); Gregory C. Brockway, Spencerport, NY (US); Bryan R. Dolan, Rochester, NY (US); Yanjia Zuo, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 14 days.

(21) Appl. No.: 13/537,660

(22) Filed: Jun. 29, 2012

(65) Prior Publication Data

US 2014/0002548 A1 Jan. 2, 2014

(51) Int. Cl.
*B41J 2/045* (2006.01)
*B41J 2/04* (2006.01)

(52) U.S. Cl.
USPC ..... 347/71; 347/54; 347/68

(58) Field of Classification Search
None
See application file for complete search history.

(56) References Cited

U.S. PATENT DOCUMENTS

| | | | | |
|---|---|---|---|---|
| 7,669,985 | B2 | 3/2010 | Stevenson | |
| 7,690,782 | B2 | 4/2010 | Odell | |
| 2009/0122119 | A1 | 5/2009 | Andrews et al. | |
| 2009/0147051 | A1 * | 6/2009 | Yamamoto | 347/47 |
| 2011/0102492 | A1 | 5/2011 | Lin et al. | |

OTHER PUBLICATIONS

3-Methacryloxypropyltrimethoxysilane CAS#: 2530-85-0, http://www.chemicalbook.com/ProductChemicalPropertiesCB6240961_EN.htm, accessed Jun. 22, 2012, (2 pages).
Tetrabutyl titanate CAS#: 5593-70-4, http://chemicalbook.com/ProductChemicalPropertiesCB6222404_EN.htm, accessed Jun. 22, 2012, (2 pages.
Tetrabutyl titanate(5593-70-4) MSDS Melting Point Boiling Point Density Storage Trans . . . , http://chemicalbook.com/ProductMSDSDetailCB6222404_EN.htm, accessed Jun. 22, 2012, (4 pages).
3-Methacryloxypropyltrimethoxysilane | Polysciences, Inc., http://www.polisciences.com/Catalog/Deportment/Product/98/categoryId_264/productID . . . , accessed Jun. 22, 2012, (2 pages).
Electronics Material Selection Guide, NuSil Silicone Technology, 2011, (9 pages).
Controlled Volatility Materials Selection Guide, NuSil Silicone Technology, 2011, (6 pages).
NuSil Technology Introduces Thin Film Adhesive Technology, http://www.nusil.com/mediarelations/2005/press-release18.aspx, accessed May 3, 2012, (1 page).
Material Safety Data Sheet, CV-2680-12 Part A, (6 pages).
Material Safety Data Sheet, CV-2680-12 Part B, (7 pages).
CV-2680-12, Controlled Volatility Film Adhesive, Apr. 5, 2011, (3 pages).

* cited by examiner

*Primary Examiner* — Geoffrey Mruk
(74) *Attorney, Agent, or Firm* — MH2 Technology Law Group LLP

(57) ABSTRACT

A printhead assembly comprises a plurality of plates stacked together. The plates form a flow path having an inlet and a nozzle. An ejection chamber is in fluid connection with the flow path. A diaphragm is in operable connection with the ejection chamber. A micro actuator is in operable connection with the diaphragm, the micro actuator being configured to actuate the diaphragm. An adhesive layer bonds at least two of the plurality of plates together. The adhesive comprises silicone.

18 Claims, 4 Drawing Sheets

PRINTHEAD AND METHOD OF MAKING THE PRINTHEAD

DETAILED DESCRIPTION

1. Field of the Disclosure

The present disclosure is directed to ink jet printheads, and in particular, to an adhesive that can be employed for fabricating printheads for UV ink applications.

2. Background

Ink jet printheads typically require multiple layers of materials as part of their fabrication. Traditional methods use layers of gold plated stainless steel sheet metal with photo chemically etched features which are brazed together to form robust structures. However, with the continued drive to improve cost and performance, use of alternate materials and bonding processes are required. Polymer layers can replace certain sheet metal components, but polymers require adhesives to bond to each other or to metal layers.

Compatibility of these adhesives with the various chemistries used in inkjet printhead fabrication can be problematic. This is especially true for UV inks and UV gel inks, which can have rigorous adhesive requirements, such as low squeeze out, B-staged thermal activation, relatively high lap shear strength and glass transition temperature, and good stability in solvents, such as toluene, methanol, and methyl ethyl ketone.

One adhesive that has been used in the past is R1500, which is a modified acrylic based adhesive available from Rogers Corporation of Chandler, Ariz. However, it has been found that when used with UV inks, the R1500 adhesive can exhibit high absorption, swelling and can cause nozzle plate non-flatness, which may lead to mis-directional jetting and overall poor jetting performance.

There remains a need for improved adhesives that can be used in printhead applications, such as UV ink printheads.

SUMMARY

An embodiment of the present disclosure is directed to a printhead assembly. The printhead assembly comprises a plurality of plates stacked together. The plates form a flow path having an inlet and a nozzle. An ejection chamber is in fluid connection with the flow path. A diaphragm is in operable connection with the ejection chamber. A micro actuator is in operable connection with the diaphragm, the micro actuator being configured to actuate the diaphragm. An adhesive layer bonds at least two of the plurality of plates together. The adhesive comprises silicone.

Another embodiment of the present disclosure is directed to a method of making a printhead. The method comprises providing a plurality plates. The plates are bonded together to form a printhead jetstack. At least two of the plurality of plates are bonded together with an adhesive layer comprising silicone.

It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated in and constitute a part of this specification, illustrate an embodiment of the present teachings and together with the description, serve to explain the principles of the present teachings.

Figure 1:
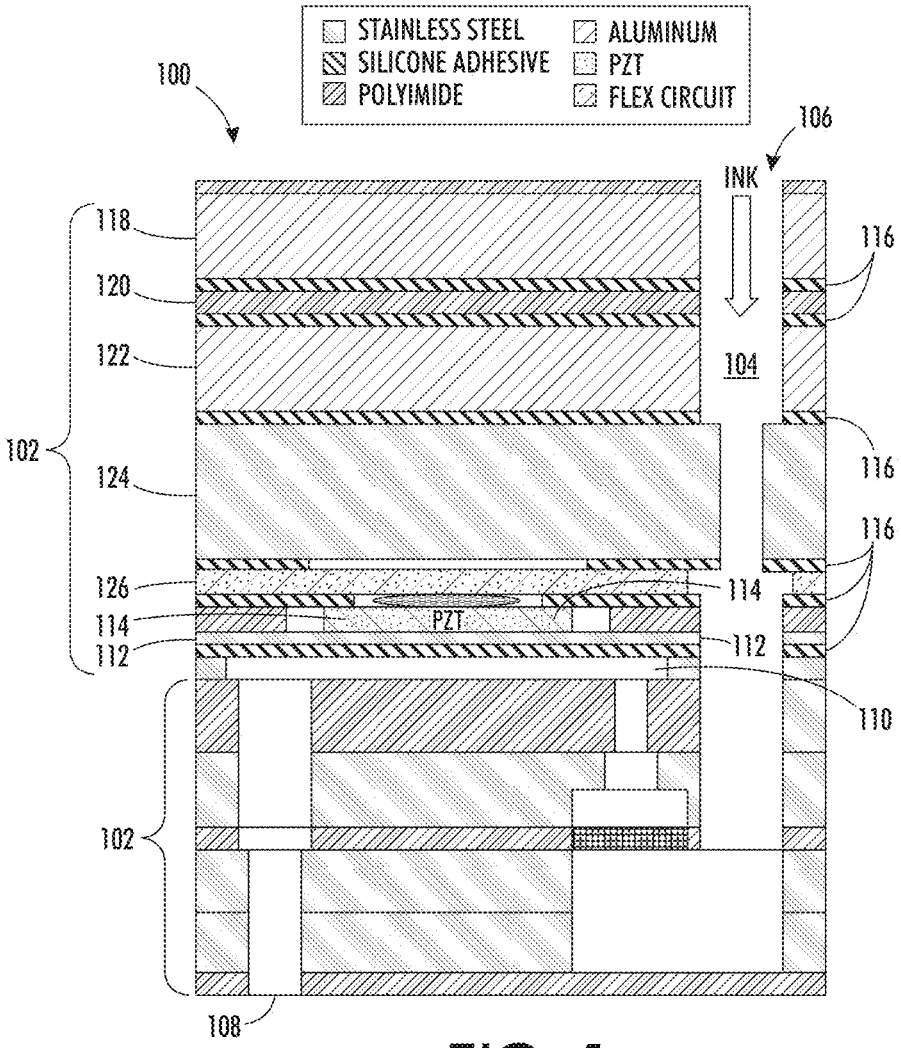
FIG. 1 illustrates a printhead that includes a silicone based adhesive, according to an embodiment of the present disclosure.

It should be noted that some details of the figure have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. In the drawings, like reference numerals have been used throughout to designate identical elements. In the following description, reference is made to the accompanying drawings that form a part thereof, and in which is shown by way of illustration a specific exemplary embodiment in which the present teachings may be practiced. The following description is, therefore, merely exemplary.

FIG. 1 schematically depicts the various components of a printhead assembly 100. The printhead assembly includes a plurality plates 102 stacked together to form a jetstack. The plates form a flow path 104 having an inlet 106 and a nozzle 108. An ejection chamber 110 is in fluid connection with flow path 104. A diaphragm 112 is in operable connection with the ejection chamber 110. A micro actuator 114 is configured to actuate diaphragm 112. In an embodiment, the printhead can be designed for dispensing UV inks, although the principles of the present disclosure are also readily applicable for use with other types of inks and/or printheads.

An adhesive is used to bond two or more of the plurality of plates 102 together. The adhesive can be in the form of a layer 116. The adhesive comprises a silicone compound. In an embodiment, the silicone can be a dialkyl silicone, wherein the alkyl groups can be chosen from $C_1$ to $C_4$ alkyls, such as methyl and ethyl. For example, the dialkyl silicone can be dimethyl silicone.

In an embodiment, one or more optional ingredients, such as accelerants, adhesion promoters and/or solvents can be used in combination with the silicone adhesive. Any suitable accelerant, adhesion promoter or solvent that can be combined with the silicone to provide a composition with acceptable properties for forming adhesive layers 116 between the plates can be used. One of ordinary skill in the art would readily be able to determine appropriate accelerants, adhesion promoters and solvents in view of the teachings of the present disclosure. Examples of suitable solvents include $C_5$ to $C_{12}$ hydrocarbons, naptha, mixtures thereof, or any other suitable solvent.

In an embodiment, the silicone and an accelerant can be applied as a two-part product where Part A comprises silicone and Part B comprises the accelerant and a solvent. An example of a suitable two-part silicone and accelerant adhesive is CV-2680-12, available from Nusil Technology of Santa Barbara, Calif. Part A of the two part CV-2680-12 adhesive comprises dimethyl silicone and Part B is a naptha solvent based accelerant mixture comprising naptha, Tetrabutyltitanate and 3-Methacryloxypropyltrimethoxysilane.

The silicone adhesive of the present disclosure can be employed between any of the plates of the printhead 100. For example, referring to FIG. 1, an adhesive layer can be employed to adhere to the printhead stack one or more of a diaphragm 112, a micro actuator 114, an external manifold plate 118, a heater plate 120, a diverter plate 122, a boss plate 124, a flex plate 126, as well as any other plates that can be employed in a printhead. Examples of other plates include separator or spacer plates, plates that include screens for filtering unwanted particles from the inks, structural plates, or plates that include an aperture or nozzle.

The materials used for the plates are not limited to the specific materials shown in FIG. 1. Rather, the plates can be made of any material suitable for use in a printhead. Examples of such materials include aluminum, stainless steel and other metals, as well as polymers, such as polyimide, and ceramics. In an embodiment, the printhead comprises at least one polymer plate. The plates can be bonded together with the silicone based adhesives of the present disclosure.

The adhesive layers of the present disclosure can have any thickness suitable for providing the desired bond between printhead plates. For example, the thickness can range from about 1 um to about 250 um, such as about 5 um to about 150 um, or about 10 um to about 75 um.

Figure 5:
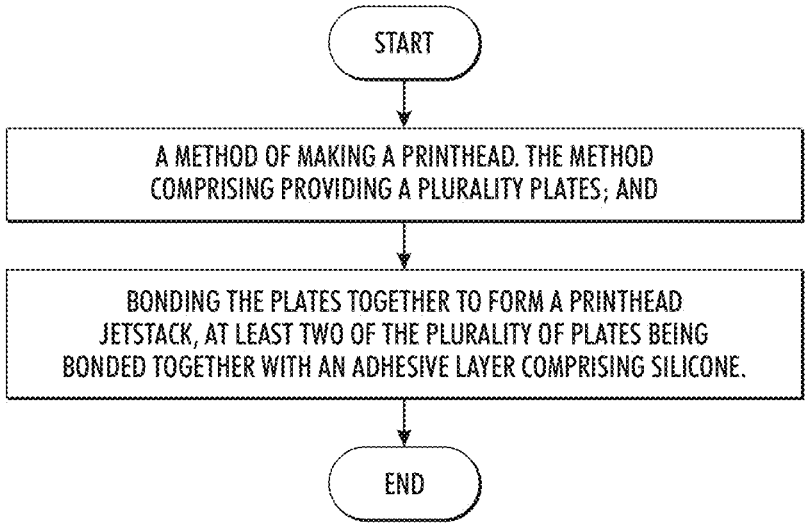
FIG. 5 illustrates a method of making a printhead, according to an embodiment of the present disclosure.

FIG. 5 illustrates a method of making a printhead, according to an embodiment of the present disclosure. The method comprises providing a plurality of plates, such as for example, any of the plates described herein for forming a printhead. The plates can be bonded together using any known process for bonding printhead plates. At least two or more of the plates are bonded together with the silicone adhesives of the present disclosure.

For example, the plates can be bonded by depositing an adhesive layer on a first plat. A second plate can then be positioning in contact with the adhesive layer. The adhesive layer can then be cured by any suitable method, such as by heating or by allowing sufficient time for curing at room temperature.

The adhesive can be applied by any suitable process. In an embodiment, the adhesive is formed as a two-part process, in which an accelerant is applied to the plates prior to the silicone. The accelerant can be applied as part of a solvent based composition. In an embodiment, the solvent can be allowed to evaporate from the plates prior to applying the silicone.

The silicone can be applied in any suitable form using any suitable deposition method. In an embodiment, the silicone is in the form of a sheet, which can allow for easy application of the adhesive for bonding the plates.

Figure 6:
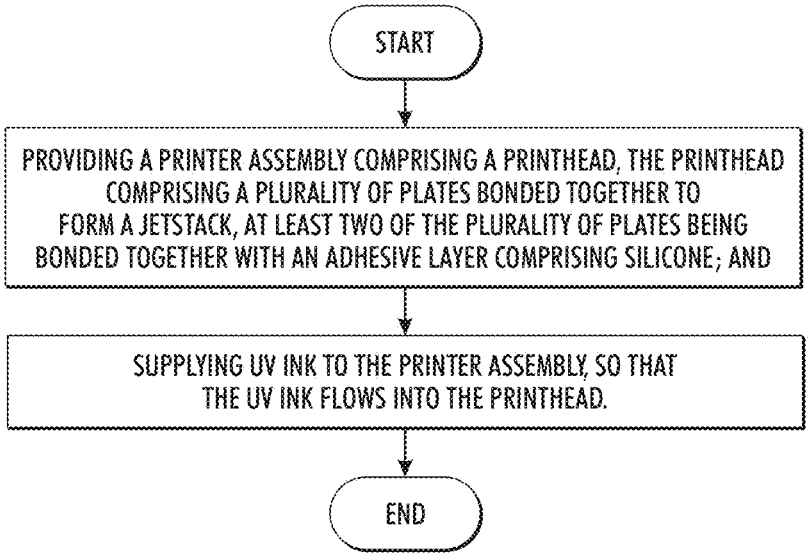
FIG. 6 illustrates a method of providing UV ink to a printhead, according to an embodiment of the present disclosure.

FIG. 6 illustrates a method of providing UV ink to a printhead, according to an embodiment of the present disclosure. The method includes providing a UV ink printing assembly comprising a printhead. Examples of UV ink printing assemblies that employ UV light sources to cure ink ejected from a printhead are well known in the art, as described, for example, in U.S. Pat. No. 7,690,782, issued Apr. 6, 2010, to Peter Gordon Odell, the disclosure of which is hereby incorporated by reference in its entirety.

The printhead of the printing assembly comprises a plurality of plates bonded together to form a jetstack. At least two of the plurality of plates are bonded together with an adhesive layer comprising silicone as discussed herein. UV ink can be supplied to the printing assembly by, for example, installing a UV ink cartridge, thereby allowing ink to flow to the printhead.

For reasons discussed in the Examples below, it is believed that printheads comprising the adhesive of the present disclosure can provide one or more advantages. For instance, it is believed that using silicone adhesive can result in significantly less weight gain of the adhesive, when compared to an acrylic based adhesive employed in an otherwise similar printhead at the same temperature for the same period of time. For example, the silicone adhesive of the present disclosure may realize a weight gain of 5% to 10% or less, such as about 3 to 4%, based on the weight of the adhesive, over a period of about 600 hours of exposure to UV ink at about 90° C.

EXAMPLES

Comparative Example 1

Figure 4:
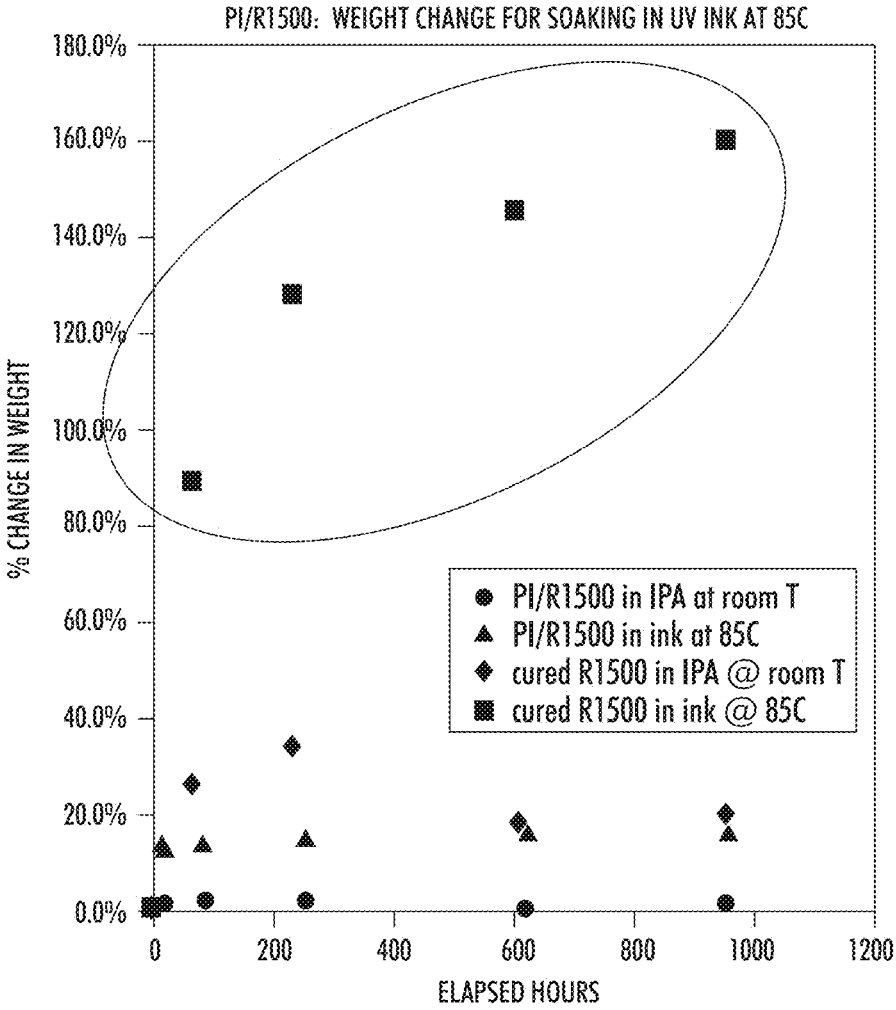
FIG. 4 shows the results of weight gain testing that was performed by soaking a cured coupon of R1500 in a bath of hot UV ink at 85 degrees Celsius.

Weight gain testing was performed by soaking a cured coupon of R1500 in a bath of hot UV ink at 85 degrees Celsius. FIG. 4 shows the results of the testing. At about 980 hours, the R1500 coupon experienced about 160% weight gain along with about a 48% dimensional change in the thickness direction.

Example 1

Testing was performed to determine the percent weight gain for CV-2680-12, a dimethyl silicone material made by Nusil Technology. A coupon containing the CV-2680-12 was soaked at about 90 degrees Celsius. Another CV-2680-12 coupon was stored at room temperature in the lab; and another was stored in air at about 90 degrees Celsius.

Figure 2:
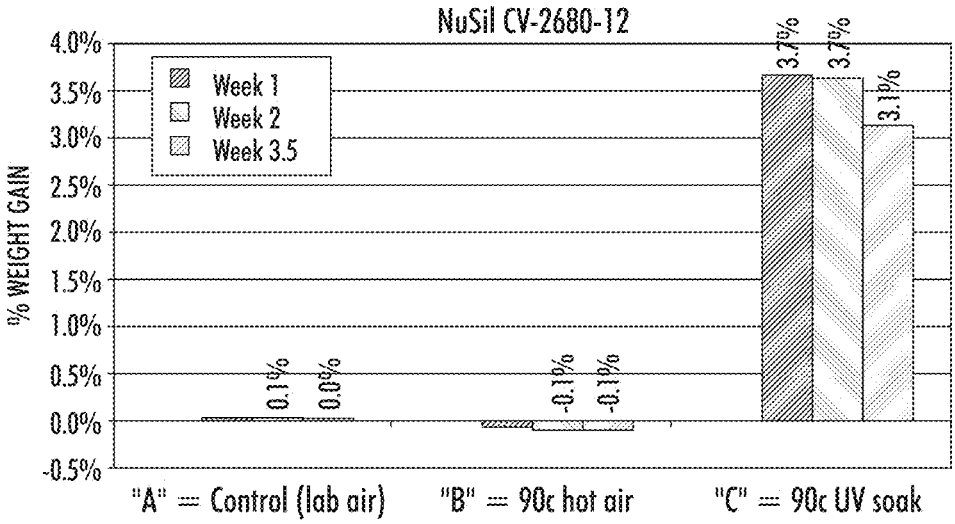
FIG. 2 shows test data for an adhesive of the present disclosure.

The results of the testing are shown in FIG. 2. After 3.5 weeks (588 hours), the Nusil material gained only about 3.1% weight, indicating much improved chemical resistance in comparison to the about 150% weight gain for R1500 shown in FIG. 4 over the same length of time. FIG. 2 further illustrates a downward trend with time, indicating that % weight gain may actually decrease (improve) past the 3.5 weeks measured.

Figure 3:
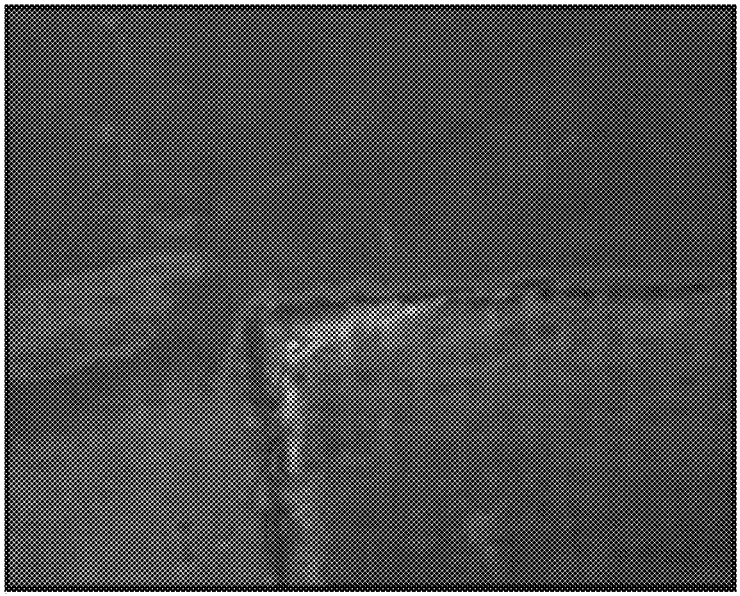
FIG. 3 shows a magnified view of the top left corner of a coupon structure comprising an adhesive of the present disclosure.

Regarding squeeze out performance, FIG. 3 shows a magnified view of the top left corner of a coupon structure comprising CV-2680-12. The total thickness of the coupon is 0.013 inches which includes a 2 mil fiberglass mesh. The edges and corner of the coupon remain sharp after a full cure, indicative of no dimensional changes of width, length or thickness.

From the results of the testing, it is believed that employing the silicone based adhesives of the present disclosure can significantly improve weight gain due to chemical incompatibility with monomers in the UV ink, relative to B-stage acrylic R1500 adhesives. With significantly improved weight gain, there may be potential for improvement in one or more of the following issues: adhesive swelling, mis-directional jetting, missing jets and poor print quality.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

While the present teachings have been illustrated with respect to one or more implementations, alterations and/or modifications can be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A printhead assembly comprising:

a plurality of plates stacked together, the plates forming a flow path having an inlet and a nozzle;

an ejection chamber in fluid connection with the flow path;

a diaphragm in operable connection with the ejection chamber;

a micro actuator in operable connection with the diaphragm, the micro actuator configured to actuate the diaphragm;

an adhesive layer bonding at least two of the plurality of plates together, the adhesive comprising the product of silicone and a mixture comprising an accelerant and solvent.

2. The printhead assembly of claim 1, wherein the silicone is dialkyl silicone.

3. The printhead assembly of claim 1, wherein the silicone is dimethyl silicone.

4. The printhead assembly of claim 1, wherein the at least two plates comprise materials chosen from stainless steel, aluminum, polymer or ceramic.

5. The printhead assembly of claim 1, wherein the adhesive layer is positioned between the at least two plates, at least one of the two plates comprising a polymer.

6. The printhead assembly of claim 5, wherein the adhesive layer has a thickness ranging from about 1 um to about 250 um.

7. The printhead assembly of claim 1, wherein the printhead is a UV ink printhead.

8. The printhead assembly of claim 1, wherein the accelerant comprises tetrabutyltitanate and 3-methacryloxypropyltrimethoxysilane.

9. The printhead assembly of claim 8, wherein the silicone is dimethyl silicone.

10. The printhead assembly of claim 9, wherein the solvent comprises naptha.

11. The printhead assembly of claim 9, wherein the adhesive layer is positioned between an external manifold plate and a heater plate.

12. The printhead assembly of claim 9, wherein the adhesive layer is positioned between a heater plate and a diverter plate.

13. The printhead assembly of claim 9, wherein the adhesive layer is positioned between a diverter plate and a boss plate.

14. The printhead assembly of claim 9, wherein the adhesive layer is positioned between a boss plate and a flex plate.

15. The printhead assembly of claim 9, wherein the adhesive layer is positioned between a flex plate and a layer comprising a micro actuator and polyimide.

16. The printhead assembly of claim 1, wherein the adhesive layer has a thickness ranging from greater than 10 um to about 250 um.

17. A printhead assembly comprising:

a plurality of plates stacked together, the plates forming a flow path having an inlet and a nozzle;

an ejection chamber in fluid connection with the flow path;

a diaphragm in operable connection with the ejection chamber;

a micro actuator in operable connection with the diaphragm, the micro actuator configured to actuate the diaphragm;

an adhesive layer bonding at least two of the plurality of plates together, the adhesive comprising the product of dialkyl silicone and a mixture comprising an accelerant and solvent, the accelerant comprising tetrabutyltitanate and 3-methacryloxypropyltrimethoxysilane.

18. The printhead assembly of claim 17, wherein the adhesive layer has a thickness ranging from greater than 10 um to about 250 um.

* * * * *